US005211300A

United States Patent [19]

Hsing et al.

[11] Patent Number: 5,211,300

[45] Date of Patent: May 18, 1993

[54] SAFETY VALVE FOR FEEDING BOTTLE

[75] Inventors: Chen Hsing; Chang Li; Koo Horng-Show, all of Hsinchu, Taiwan

[73] Assignee: Industrial Technology Research Institute, Hsinchu, Taiwan

[21] Appl. No.: 955,160

[22] Filed: Oct. 1, 1992

[51] Int. Cl.[5] ..... A61J 9/02

[52] U.S. Cl. ..... 215/11.4; 222/54; 236/93 B

[58] Field of Search ..... 215/11.1, 11.2, 11.4; 220/201, 202; 222/54; 236/93 B

[56] References Cited

U.S. PATENT DOCUMENTS

| | | | |
|---|---|---|---|
| 3,084,706 | 4/1963 | Lunde | 220/202 X |
| 3,215,311 | 11/1965 | Nison et al. | 222/54 X |
| 4,141,461 | 2/1979 | LaChance | 220/253 |
| 4,430,392 | 2/1984 | Kelley et al. | 220/202 X |
| 4,431,716 | 2/1984 | Eppley et al. | 220/202 X |
| 4,480,784 | 11/1984 | Bennett | 236/93 B |
| 4,848,653 | 7/1989 | Van Becelaere | 236/101 D X |
| 4,856,995 | 8/1989 | Wagner | 215/11.4 X |
| 4,878,588 | 11/1989 | Ephraim | 215/11.2 |
| 5,000,581 | 3/1991 | Yata et al. | 215/11.2 |
| 5,060,811 | 10/1991 | Fox | 215/11.4 X |

FOREIGN PATENT DOCUMENTS

| | | | |
|---|---|---|---|
| 290418 | 11/1988 | European Pat. Off. | 220/253 |
| 2169210 | 7/1986 | United Kingdom | 215/11.4 |

*Primary Examiner*—Allan N. Shoap
*Assistant Examiner*—McDonald Christopher J.
*Attorney, Agent, or Firm*—Cushman, Darby & Cushman

[57] ABSTRACT

A safety valve for mounting on the opening of a feeding bottle. The safety valve has an outer cap with a raised flat top in the middle with perforations thereon, and a flanged inner cap with a raised flat top in the middle disposed inside an interior space defined by the side wall and the raised flat top of the outer cap. The inner cap is rotatable with respect to the outer cap from an open position to a closed position. The raised flat top of the inner cap has a plurality of through holes formed thereon which, when in the open position, are in alignment with the perforations formed on the raised flat top of the outer cap to form passages for the milk contained in the feeding bottle to flow therethrough. A plurality of temperature sensitive springs and a regular spring are connected between the outer and inner caps to rotate the inner cap to the closed position when the temperature of the milk is higher than a pre-specified range and to return the inner cap to the open position when the milk is cooled down.

8 Claims, 3 Drawing Sheets

SAFETY VALVE FOR FEEDING BOTTLE

BACKGROUND OF THE INVENTION

The present invention relates generally to a baby feeding bottle and in particular to a safety valve for a feeding bottle which is closable when the temperature of the milk inside the feeding bottle is higher than a pre-specified temperature, preventing the baby from being hurt by high temperature milk.

A feeding bottle usually comprises a bottle body with an opening to receive therein a milk solution of milk powder in hot water, and a rubber teat which is tightly fit on the opening and has one or two through holes for feeding a baby therethrough. The temperature of the milk for feeding the baby should be kept within a given range, for high temperature may hurt the baby's mouth and throat, while low temperature may cause stomach problems and is less attractive to the baby.

There are many ways that a baby sitter or a parent can test the temperature of the milk. For example, a parent may taste the milk with his or her mouth to determine if the temperature is appropriate; it is quite possible for the parent to transmit a disease to the baby in this way. Another disadvantage of this method is that the baby may not have the same feeling regarding the milk temperature as the parent does. In other words, what is considered appropriate by the parent may not be the same for the baby.

Another way to test the milk temperature is to drop one or two droplets of the milk on a hand or an arm to check the temperature or to hold the bottle with a hand to indirectly check the temperature with the palm of the hand. A disadvantage of these methods is that the baby's feeling of the milk temperature may be different from that of the parent, since the parent is feeling the temperature with his or her skin while the baby is feeling the temperature with its mouth.

It is therefore desirable to have a feeding bottle with a temperature sensitive safety valve which controls the flowing out of the milk inside the bottle body in accordance with the temperature of the milk to regulate a suitable temperature to a baby.

SUMMARY OF THE INVENTION

A primary object of the present invention is therefore to provide a safety valve for a feeding bottle which is closable to block the milk flow when the temperature of the milk inside the bottle is higher than a pre-specified temperature range.

It is another object of the present invention to provide a safety valve for a feeding bottle which uses temperature sensitive springs to control the opening and closing of the valve.

It is a further object of the present invention to provide a feeding bottle which incorporates a safety valve closable in response to the temperature of the milk contained in the bottle, to keep the milk from flowing out when the temperature is higher than a pre-specified level.

To achieve the above-mentioned object, a safety valve is to be mounted on the opening of a feeding bottle. The safety valve comprises an outer cap having a base part and a raised flat top with perforations in the middle and a flanged inner cap disposed inside an interior space defined by the base part and the perforated flat top of the outer cap to be rotatable with respect to the outer cap from an open position to a closed position.

The inner cap has a plurality of through holes formed thereon which, when in the open position, are in alignment with the perforations formed on the flat top of the outer cap to form passages for the milk contained in the feeding bottle to flow therethrough. A plurality of temperature sensitive springs and a regular spring are connected between the outer and inner caps to rotate the inner cap to the closed position when the temperature of the milk is higher than a pre-specified range and to return the inner cap back to the open position when the milk has been cooled.

Other objects and advantages of the invention will be apparent from the following description of a preferred embodiment taken in connection with the drawings.

DETAILED DESCRIPTION OF THE INVENTION

Figure 1:
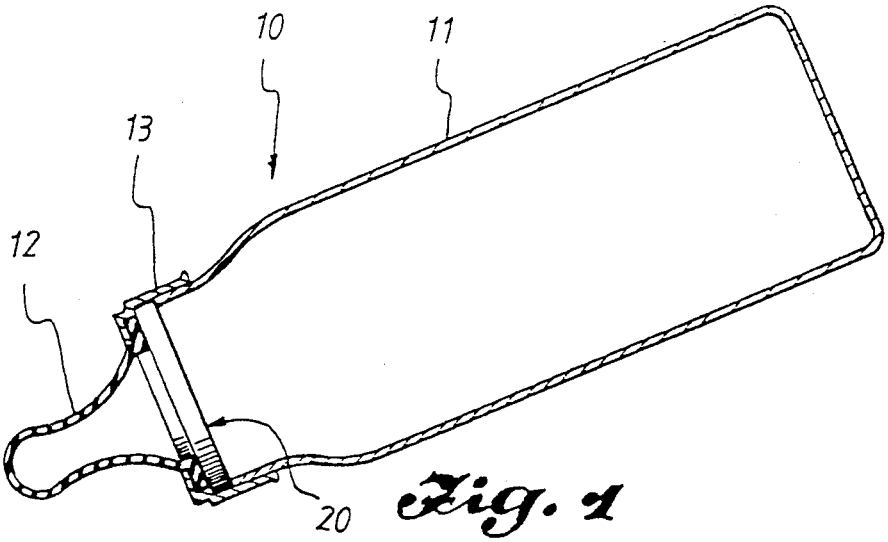
FIG. 1 is a longitudinal sectional view showing a feeding bottle with a safety valve in accordance with the present invention installed therein.

With reference to FIG. 1, a feeding bottle 10 comprises a bottle body 11 with an opening threaded outside formed on one end thereof to receive therein milk (not shown) to feed a baby (not shown) and a rubber teat 12 which is secured on the opening by a threaded securing ring 13. A safety valve in accordance with the present invention, generally designated with the reference numeral 20, is held between the opening of the bottle body 11 and the rubber teat 12 to cover the opening of the bottle so that when the safety valve is closed, the milk contained in bottle body 11 is not allowed to run out. The safety valve 20 is secured in position partly by the securing ring 13.

Figure 2:
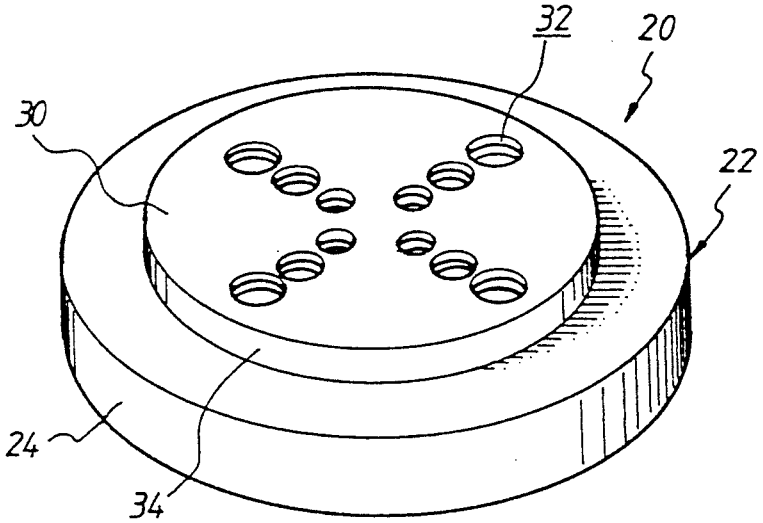
FIG. 2 is a perspective view of the safety valve in accordance with the present invention.
Figure 3:
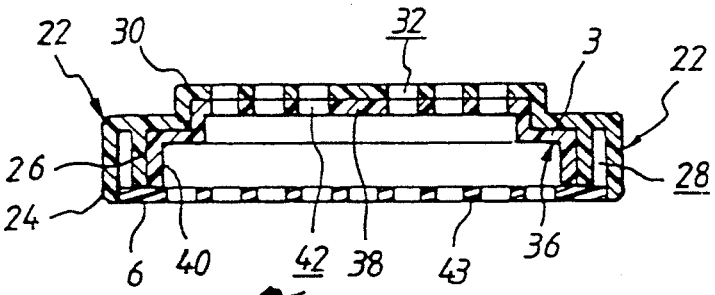
FIG. 3 is a cross-sectional view of the safety valve shown in FIG. 2 wherein some parts of the safety valve are removed to more clearly illustrate the structure thereof.
Figure 4:
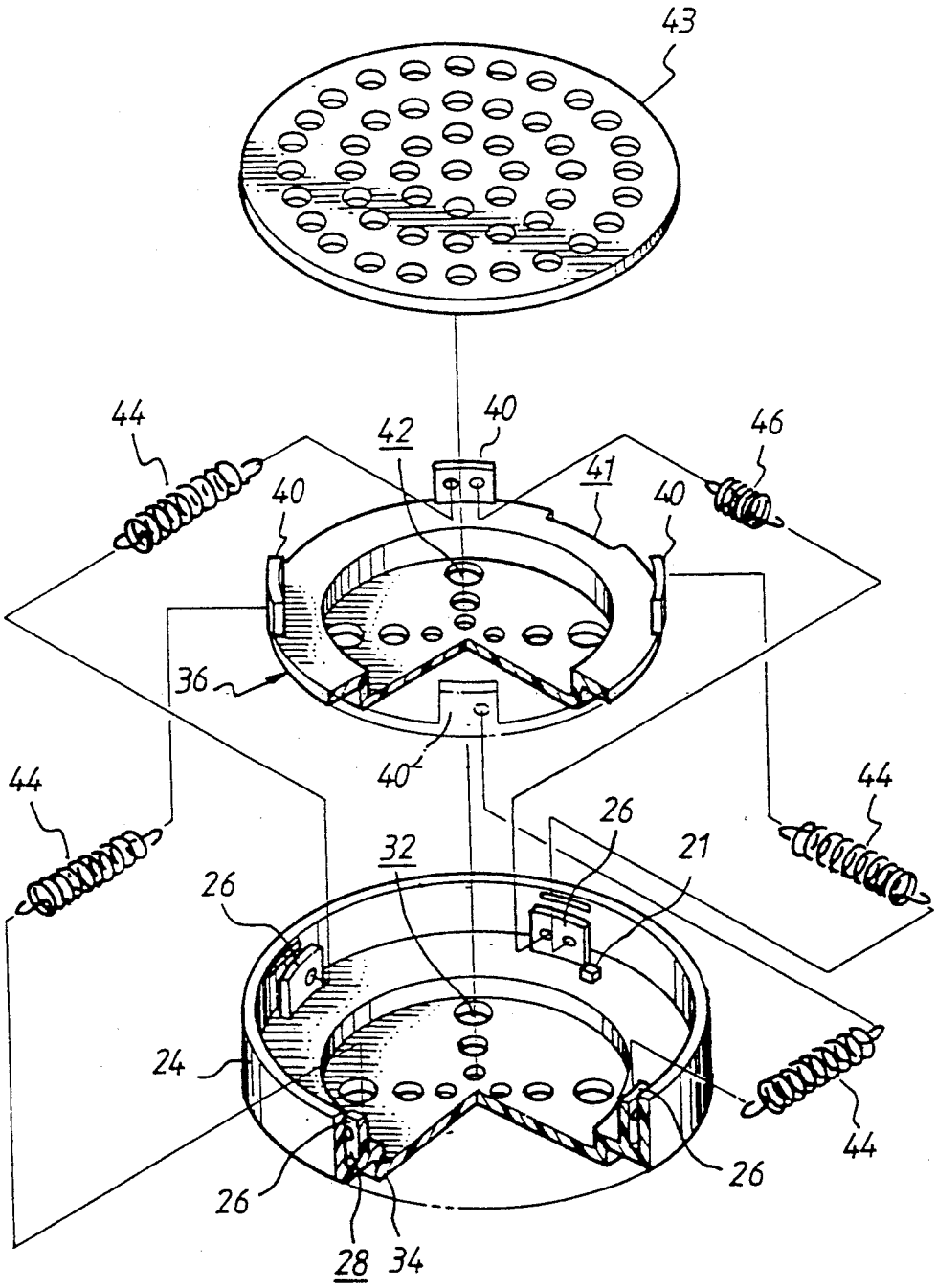
FIG. 4 is an exploded fragmentary view of the safety valve shown in FIG. 2 viewed from a reverse direction.

With reference to FIGS. 2, 3 and 4, the safety valve 20 of the present invention comprises a first member 22 in the form of an outer cap with a base 24 and a raised flat top 30 which is substantially complementary to the shape of the opening of the bottle body 11 so it tightly fits on the opening. The first member 22 has a plurality of inner wall segments 26 substantially coaxial with the outer wall of the base 24. A plurality of through apertures 32 are formed on the raised flat top 30. The shoulder 34 of the raised flat top 30 is to be fit by the rubber teat 12. Since typically, the opening of the bottle body 11 is circular, the first member 22 is in the form of a cylindrical cap to match the shape of the opening. However, other shapes may be adopted to form the first member 22 if a feeding bottle with a non-circular opening is desired.

The inner wall segments 26 and the raised flat top 30 of the first member 22 define an interior space within which a second member 36, in the shape of a flanged inner cap, complementary in shape and size to the interior space, is disposed. The second member 36 has a raised flat top 38 in close contact with the raised flat top 30 of the first member 22 and a plurality of perpendicular flange segments 40 depending from the periphery of the flange thereof on the side opposite to the raised flat top 38, and substantially opposing the inner wall segments 26 of the first member 22.

Figure 5:
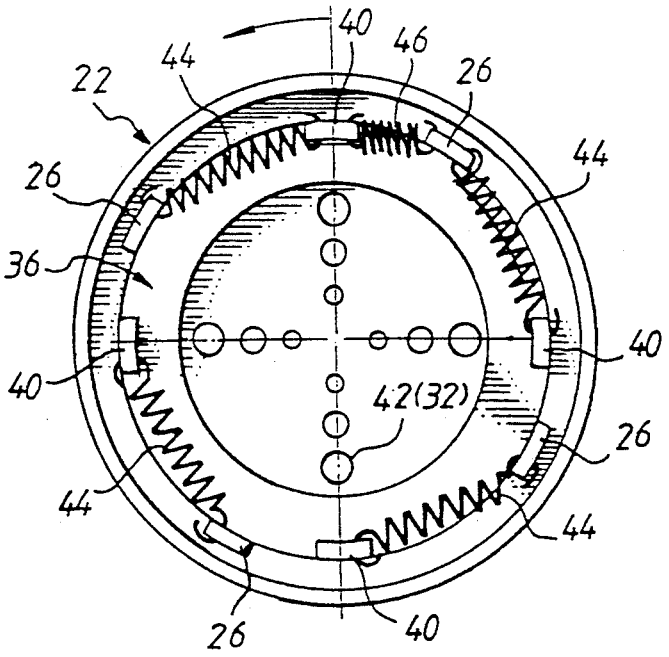
FIG. 5 is a plane view showing the situation when the safety valve of FIG. 2 is in the open position.
Figure 6:
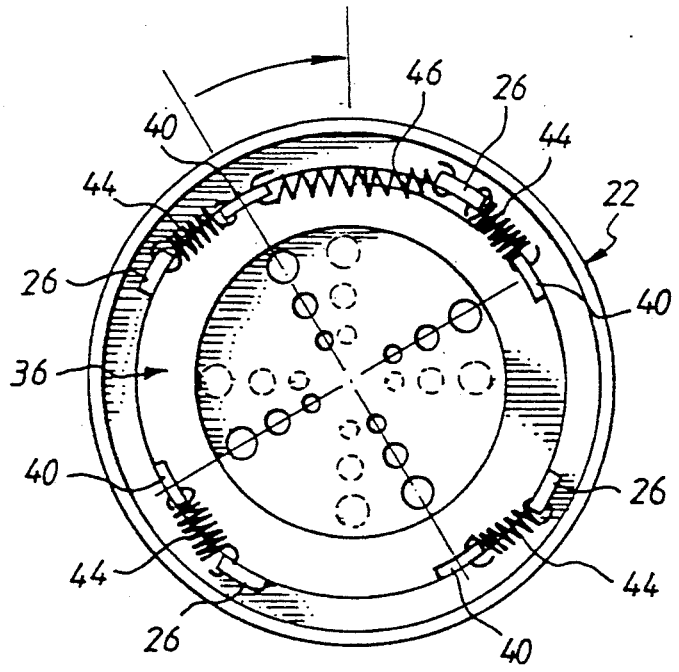
FIG. 6 is a plane view showing the situation when the safety valve of FIG. 2 is in the closed position.

The second member 36 is disposed inside the first member 22 in such a way to be rotatable in a range limited by a stop 21 on the inside of the base 24 in conjunction with a cut 41 on the periphery of the flange of the second member 36 relative to the first member 22 from an open position (see FIG. 5) to a closed position (see FIG. 6).

The raised flat top 38 of the second member 36 has a plurality of through holes 42 formed thereon. Preferably, the number and location of the through holes 42 of the second member 36 correspond to the through apertures 32 of the first member 22 so that when the second member 36 is in the open position, the through holes 42 of the second member 36 are in alignment with the through apertures 32 of the first member 22 to form passages for the milk to flow therethrough.

It can be noted that when the second member 36 is in the closed position, the through holes 42 and the through apertures 32 are offset or out of alignment with respect to each other to close the passages through which the milk can flow through.

A perforated bottom cover 43 may be disposed to cover the open end of the first member 22 and rotatably secure the second member 36 inside the first member 22.

With particular reference to FIG. 4, the first member 22 and the second member 36 are mechanically connected together with a plurality of temperature sensitive springs 44, for example, four temperature sensitive springs are evenly distributed around the second member 36 in the embodiment shown in the drawings. The two ends of each of the temperature sensitive springs 44 are respectively hooked to corresponding holes of one of the inner wall segments 26 of the first member 22 and one of the flange segments 40 of the second member 36 so as to relatively rotatably connect the first member 22 and the second member 36 together.

These temperature sensitive springs 44 are preferably made of a shape memory alloy which, after being heated to a specific temperature, will restore its original shape. Such a restoration of shape is done by the metallurgical phase transformation caused by temperature variation. The phase transformation temperature of a shape memory alloy is dependent upon the micro-structure of the alloy or more specifically, dependent upon the force required to move the dislocations inside the alloy. Thus such a phase transformation temperature can be artificially set. In this embodiment, since the acceptable milk temperature for a baby should not be higher than 40°-55° C., the phase transformation temperature of the temperature sensitive springs 44 is set to be 40°-55° C.

For the purposes of the present invention, the temperature sensitive springs 44 are made to contract when the environmental temperature (i.e. the temperature of the milk) is higher than the phase transformation temperature and these springs extend when the environmental temperature is lowered down to be lower than the phase transformation temperature. It should be noted that the temperature sensitive springs 44 can also be made to work in a reverse direction, namely extending when the environmental temperature is higher than the phase transformation temperature and contracting when the environmental temperature is lower than the phase transformation temperature.

When the milk temperature is higher than the phase transformation temperature and when a parent is trying to feed a baby and thus inclining the feeding bottle 10, the high temperature milk flows around and thus immersing the temperature sensitive springs 44 before it flows out of the rubber teat 12 and thus the springs 44 are subject to the high temperature and undergo contraction deformation to rotate the second member 36 to the closed position.

A regular spring 46 is also hooked to one of the inner wall segments 26 of the first member 22 and one of the flange segments 40 of the second member 36 in such a way to act in a direction which is reverse to that of the action of the temperature sensitive springs 44. Thus, if, for example, the temperature sensitive springs 44 contract to rotate the second member 36 to the closed position (as shown in FIG. 6) due to the high temperature of the milk, the regular spring 46 is elongated. The elongation of the regular spring 46 intends to rotate the second member 36 toward the open position (see FIG. 5) to allow the milk to flow therethrough, when the milk whose temperature is originally higher than the phase transformation temperature has cooled down and the temperature sensitive springs 44 extends.

The purpose of using a plurality of temperature sensitive springs evenly distributed around a circumference of the first member 22 is to ensure that at least one of the temperature sensitive springs 44 is immersed in the hot milk when the feeding bottle 10 is inclined for feeding a baby.

It is apparent that although the invention has been described in connection with a preferred embodiment, those skilled in the art may make changes to certain features of the preferred embodiment without departing from the spirit and scope of the invention as defined in the appended claims.

What is claimed is:

1. A safety valve for a feeding bottle, said feeding bottle comprising a bottle body with an opening to receive therein milk and a rubber teat mounted on the opening of the bottle body, said safety valve which is disposed between the opening of the bottle and the rubber teat comprising:

a first member which is in the form of an outer cap with a first raised flat top in the middle having a plurality of first through holes formed thereon, said first member further comprising a plurality of inner wall segments substantially coaxial with an outer wall of said outer cap to define an interior space with said first raised flat top;

a second member which is in the form of a flanged inner cap with a second raised flat top in the middle with a plurality of flange segments depending from a periphery of a flange on a side opposite to said second raised flat top, said second member being disposed in said interior space of the first member in such a way to be rotatable relative to said first member from an open position to a closed position, said second raised flat top having a plurality of second through holes formed thereon corresponding to said first through holes of the first member in said open position; and a plurality of temperature sensitive springs disposed between said first member and said second member in such a way to be immersible in the milk to sense the temperature thereof, each of said temperature sensitive springs having two ends respectively fixed on one of said inner wall segments of the first member and one of said flange segments of the second member, each of said temperature sensitive springs being deformable along a first direction of a longitudinal axis thereof when the temperature of the milk is higher than a pre-specified temperature range for causing movement from said open position to said closed position, and deformable along a second direction which is opposite to the first direction when the temperature of the milk is lower than the pre-specified temperature range for causing movement from said closed position to said open position.

2. A safety valve as claimed in claim 1 further comprising a regular spring connected between said first member and said second member in such a way to bias said second member toward the open position to counter-act said temperature sensitive springs when the temperature of the milk is lower than said pre-specified temperature range.

3. A safety valve as claimed in claim 1 further comprising a perforated bottom cover which is disposed on an open end of said first member to secure said second member in the interior space of said first member.

4. A safety valve as claimed in claim 1 wherein said temperature sensitive springs are substantially evenly distributed around a circumference of said first member to ensure that at least one of the temperature sensitive springs is immersed in the milk to sense the temperature thereof when the feeding bottle is inclined.

5. A safety valve as claimed in claim 1 wherein the first direction of the deformation of said temperature sensitive springs is to contract said temperature sensitive springs, and wherein the second direction of the deformation of said temperature sensitive springs is to extend said temperature sensitive springs.

6. A safety valve as claimed in claim 1 wherein said temperature sensitive springs are made of a shape memory alloy.

7. A safety valve as claimed in claim 1 wherein said pre-specified temperature range is 40° to 55° C.

8. A safety valve as claimed in claim 1, wherein the first direction of the deformation of said temperature sensitive springs is to extend said temperature sensitive springs, and wherein the second direction of the deformation of said temperature sensitive springs is to contract said temperature sensitive springs.

* * * * *